US005203034A

United States Patent [19]

Foehl

[11] Patent Number: 5,203,034

[45] Date of Patent: Apr. 20, 1993

[54] OPERATING DEVICE FOR PROTECTIVE HELMETS

[76] Inventor: Artur Foehl, Auf der Halde 28, D-7060 Schorndorf, Fed. Rep. of Germany

[21] Appl. No.: 803,476

[22] Filed: Dec. 4, 1991

Related U.S. Application Data

[63] Continuation-in-part of Ser. No. 472,952, Jan. 31, 1990, abandoned, which is a continuation-in-part of Ser. No. 194,993, Jun. 22, 1988, abandoned.

[30] Foreign Application Priority Data

Aug. 22, 1986 [DE] Fed. Rep. of Germany ..... 3628493

[51] Int. Cl.[5] ..... A42B 7/00

[52] U.S. Cl. ..... 2/421; 2/425

[58] Field of Search ..... 2/410, 421, 424, 425, 2/422

[56] References Cited

U.S. PATENT DOCUMENTS

| | | | |
|---|---|---|---|
| 3,467,964 | 9/1969 | Hannan | 2/410 |
| 4,110,847 | 9/1978 | Dera | 2/421 |
| 4,982,452 | 1/1991 | Chaise | 2/421 |

FOREIGN PATENT DOCUMENTS

| | | |
|---|---|---|
| 52068 | 5/1982 | European Pat. Off. . |
| 77015 | 4/1983 | European Pat. Off. . |
| 134183 | 3/1985 | European Pat. Off. . |
| 194324 | 9/1986 | European Pat. Off. . |
| 236912 | 9/1987 | European Pat. Off. . |
| 357838 | 3/1990 | European Pat. Off. . |
| 3143796 | 5/1983 | Fed. Rep. of Germany . |
| 3300277 | 7/1984 | Fed. Rep. of Germany . |
| 3330697 | 3/1985 | Fed. Rep. of Germany . |
| 3430413 | 2/1986 | Fed. Rep. of Germany . |
| 2430736 | 2/1980 | France . |
| 2525084 | 10/1983 | France . |
| 2525441 | 10/1983 | France . |
| 7406933 | 11/1975 | Netherlands . |
| 8906915 | 8/1989 | PCT Int'l Appl. . |

*Primary Examiner*—Clifford D. Crowder
*Assistant Examiner*—Michael A. Neas
*Attorney, Agent, or Firm*—Eckert Seamans Cherin & Mellott

[57] ABSTRACT

A locking or adjustment device is placed on the of the shell of a helmet for the purpose of attaching, securing, detaching or adjusting the effective length of a chin strap or cheek strap. The locking device may be part of a multi-part or flip-up helmet shell. A manual control device is located on the helmet shell and is accessible from the outside of the shell such that manual pressure on the control surface of the control device from outside the shell disengages a connection with the chin strap. The control device is integrated with the helmet shell in the area of the neck ring, preferably on the side of the neck ring. In a neutral position of the control device, the control surface thereof is continuous with an exterior surface of the helmet shell.

12 Claims, 7 Drawing Sheets

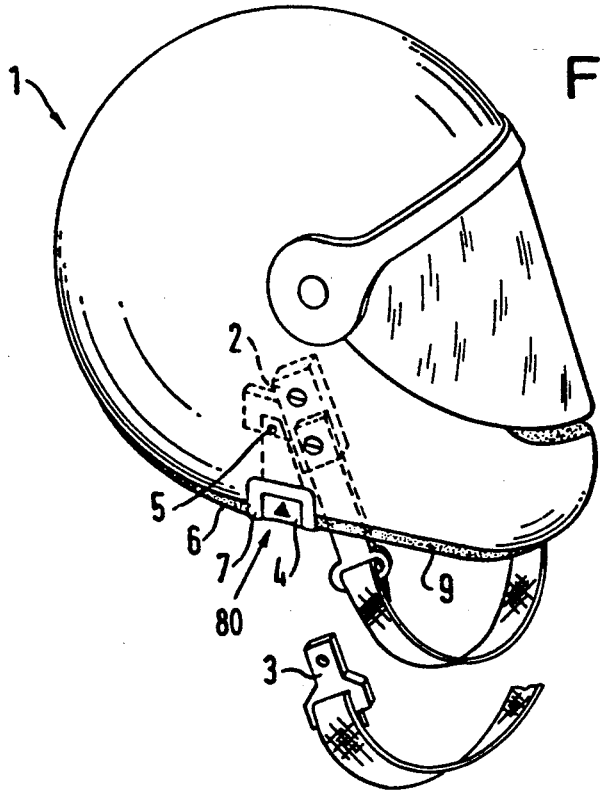
FIG. 1
FIG. 2
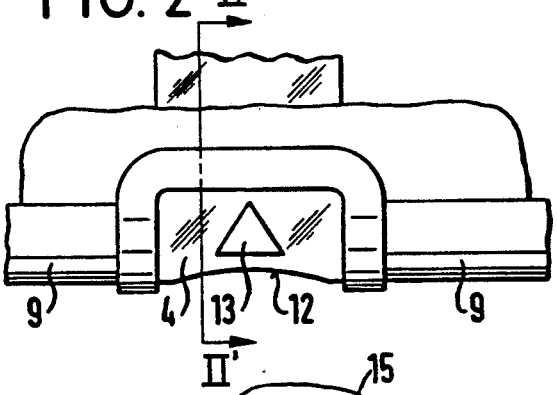
FIG. 2'
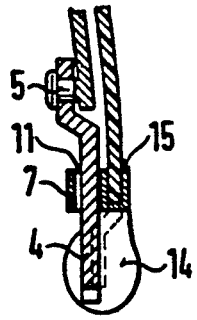
FIG. 3
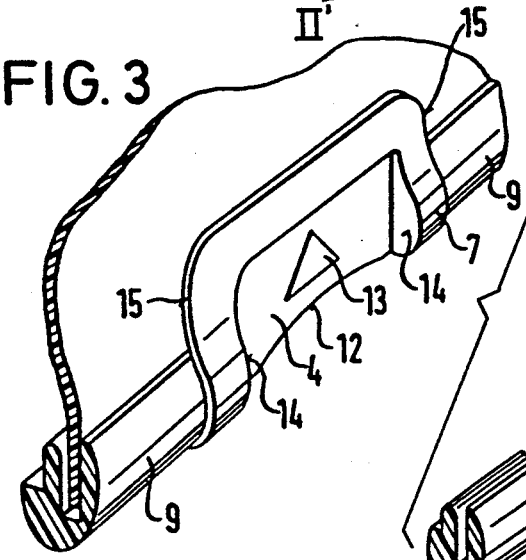
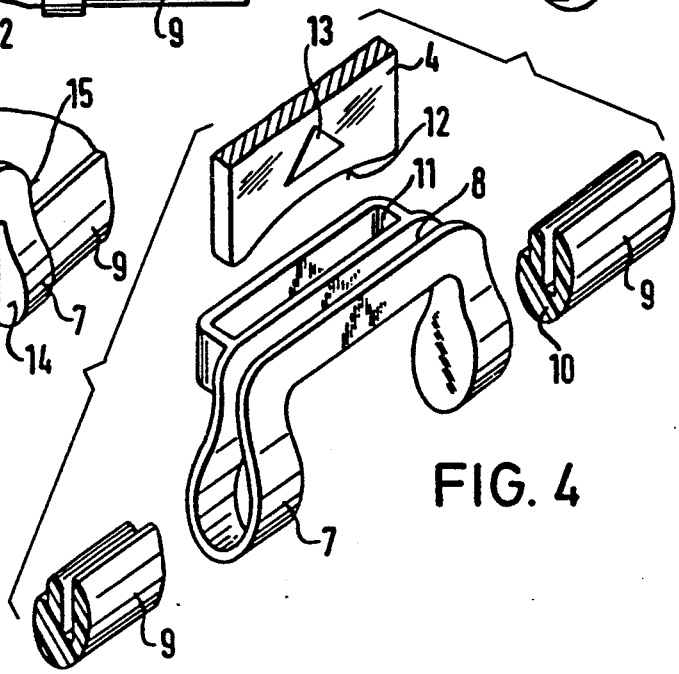
FIG. 4

FIG. 9
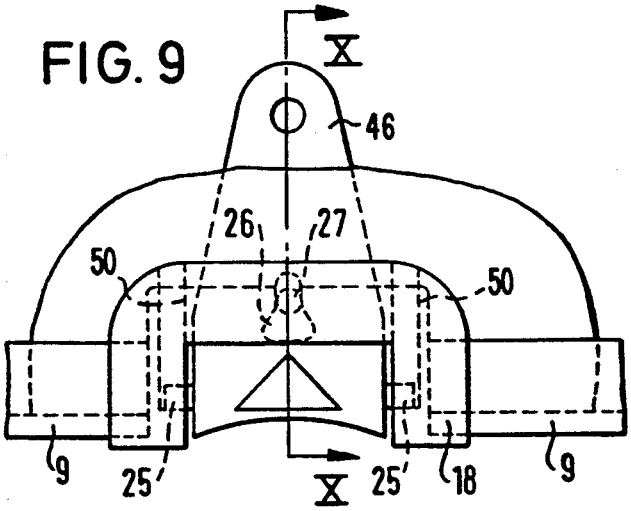
FIG. 10
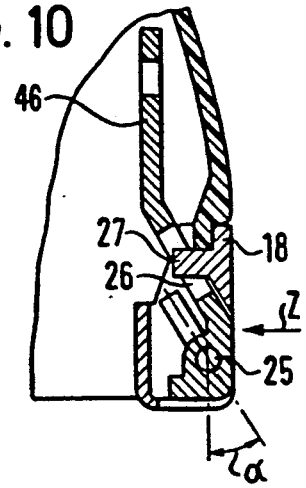
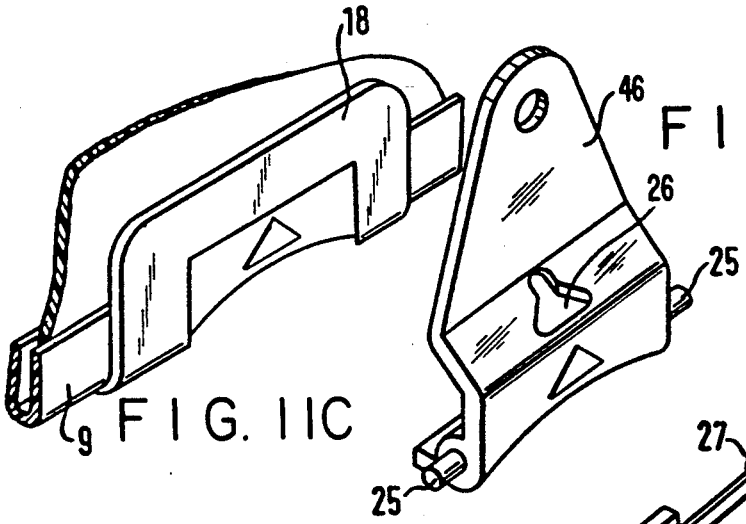
FIG. 11A
FIG. 11C
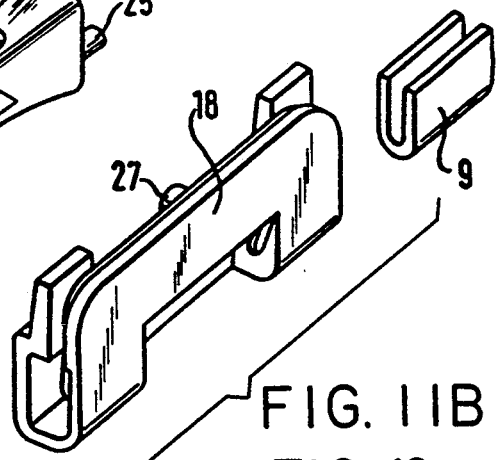
FIG. 11B
FIG. 12
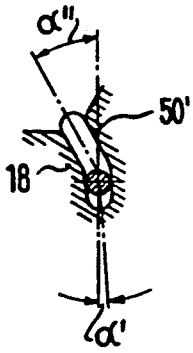
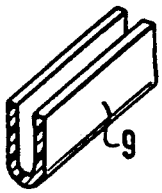
FIG. 13
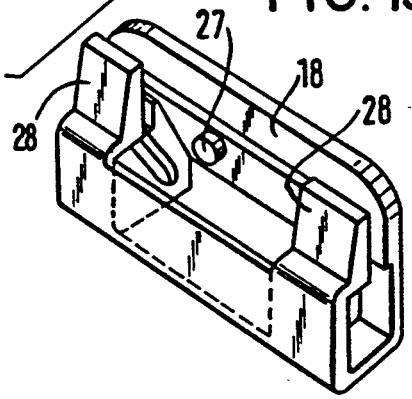

OPERATING DEVICE FOR PROTECTIVE HELMETS

This application is a continuation-in-part of application Ser. No. 472,952 filed Jan. 31, 1990 now abandoned which was a continuation-in-part of application Ser. No. 194,993 filed Jun. 22, 1988.

BACKGROUND OF THE INVENTION

The invention refers to a device for activating a locking or adjustment device placed inside the shell of a helmet for the purpose of attaching, securing, detaching, or adjusting a cheek strap by means of a manually accessible handle on the outside of the helmet. Such operating devices serve to open or close cheek straps on crash helmets or protective helmets, primarily for motorcycle drivers. But for helmet shells with several parts and/or helmet shells which can be swung upwards, there is a necessity to be able to operate the plug-type connection from the outside by means of a device for e.g. opening or locking it.

In known adjustment or closing devices which are fixed on the helmet side, notches are provided on the side of the helmet shell, in which pull or push keys are accessible for operating the closing or adjustment devices for the cheek strap. Due to the required accessibility of these safety devices—for instance, they must be operable with the thumb of a gloved hand—the openings in the helmet shell must be correspondingly large.

In the practice, this leads to e.g. the following disadvantages:

1. During driving at high speeds, very strong noise occurs, which might even cause damage to the hearing;
2. It is difficult to close the openings against wetness penetrating form the outside;
3. In order to ease operation, the manual controls must be designed as depressions, whereby, in the case of certain depression shapes, the danger of them being caught on something in case of a fall cannot be wholly eliminated.

SUMMARY AND OBJECTS OF THE INVENTION

A device of the conventional type is disclosed, for example, in Offenlegungsschrift Pat. No. DE 33 30 697 (Mar. 28, 1985). This document, as shown in FIGS. 21 and 22, discloses an arrangement wherein the cheek strap or chin strap 105 of a protective helmet 101 is fixed on one ®nd 106 to the inside of the helmet shell 101", and on the opposite end is adjustably mounted in a fitting 115 so as to render the chin strap 105 length adjustable. The adjustably mounted end of the strap 109 has a plurality of inward-facing notches 111 defining a span of adjustment. The notches 111 engage at a point selected by the user with a tab 120 having teeth 123 that correspond to the notches 111. The tab 120 is resiliently urged against the strap notches 111 by a spring 125, to hold the strap 105 at a desired length. The tab 120 can be lifted (inwardly of the helmet shell 101") against the pressure of the spring 125 by means of a push key 136 that protrudes through a hole in the helmet shell 101". In this manner the user can press the push key 136 from outside the helmet 101 and thereby disengage the tab 120 from the notches 111 to effect an adjustment of the strap 105 length. Upon releasing the push key 136, the strap 105 becomes fixed. Having an opening in the helmet shell to accommodate the push key, such a device suffers from the aforementioned disadvantages known to conventional protective helmets, i.e. wind noise, intrusion of weather elements and increased danger in the event of a fall.

The purpose of the invention is to provide an operating, or control, device for such closing or adjustment devices, which operating device can be manipulated in a simple manner, which does not necessitate any side opening in the helmet shell, and which, in case of danger, is nevertheless easily operable and consequently does not involve the above mentioned disadvantages.

In the operating device according to the invention, a control part is thus moved from the side surface of the helmet shell to the lower edge area, preferably integrally with the profile of the lower, or neck, edge. Thereby, the control part is integrated into the edge area so that it is operable by pushing upwardly at the edge area of the helmet shell, whereby, in the neutral position, the outside contour of the helmet shell having the control part remains essentially unchanged.

In order to guarantee this in a particularly simple manner, another further development of the inventive concept provides a guide opening in the helmet shell, which opening, when seen from the bottom upwards into the interior of the helmet, is designed with an inward bend. Thereby, the control part itself is accordingly bent, so that in the inactive position, the outside of the control part rests in the surface of the helmet shell, while, when moved, it is guided inward according to the slope of the guide surface and can be pushed upwards in order to correspondingly affect the switching elements of the closure or the adjustment elements.

Instead of guiding the control part in a guide opening, another further development of the inventive concept also provides a type link guidance, whereby guide grooves are provided in the guide part and guide pegs on the control part. In such an embodiment the inward movement of the control part can also be attained by means of varying angles along its path.

Thereby, according to yet another embodiment, the control part may also be journalled in the guide opening according to the principle of a double lever, whereby a portion located inside the helmet shell becomes operative when the control part is tilted "into itself", while the outside surface of the control part, which completes the helmet shell, is thereby pushed outwards. In this case as well, the surface shape of the edge area of the helmet shell remains continuous without any protrusions when in the neutral position.

According to another advantageous embodiment, the guide piece for the control part may be connected with the neck edge profile or even form one constructive unit with it, so that particular attachment devices on the helmet shell itself are superfluous. By means of such provisions, the danger of injury from the attachment parts (rivets) in case of a fall etc. are additionally reduced.

BRIEF DESCRIPTION OF THE DRAWINGS

In the following, the invention will be explained on the basis of the following examples in conjunction with the enclosed drawings.

The following is shown in these drawings:

FIG. 1 is a perspective view of a protective helmet with the operating device according to the invention.

FIG. 2 is a top view of the manual control area.

FIG. 2' is a partial sectional view from II'—II' in FIG. 2.

FIG. 3 is a perspective detail view.

FIG. 4 are individual parts of the manual control guidance device, in an exploded view.

FIG. 9 is a top view of the manual control area of a third execution example.

FIG. 10 is a sectional view through the manual control form X—X in FIG. 9.

FIGS. 11A & B are individual parts of the manual control part, in an exploded view.

FIG. 11C is a perspective view of the parts of FIGS. 11A-B in an assembled status.

FIG. 12 is a detail of the journalling of the manual control part.

FIG. 13 is the guide piece in a perspective view of the execution according to FIGS. 9-2.

DETAILED DESCRIPTION OF THE EMBODIMENTS

Figure 5:
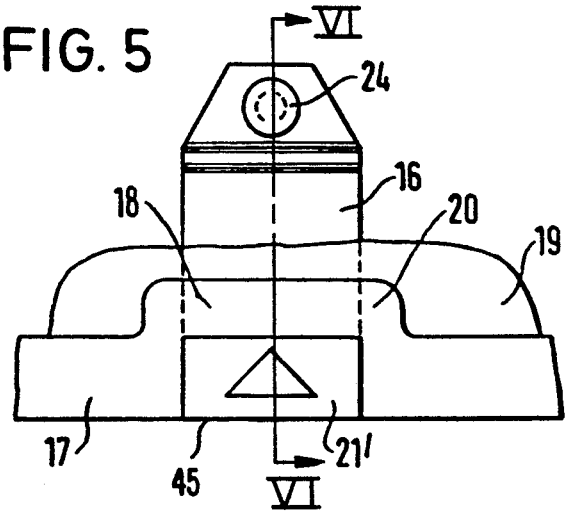
FIG. 5 is a top view of the manual control area of a second execution example.

FIG. 1 shows a protective helmet 1 with a chin strap adjustment device 2 located on the inside of the helmet. A control device 80 for operating the closure or adjustment device acts on the adjustment or locking mechanism, which may be of the type shown in FIG. 23 and is not shown in detail in FIG. 1, via an activation connection 5.

In the area of the control device 80, helmet edge 6 is cut out to accommodate a guide part 7, which has a corresponding attachment groove. A side 10 (FIG. 4) of the neck ring 9 is inserted into the guide part 7. In the assembly, manual control part 4, which has a rectangular cross section in the view area, is brought through the guide opening 11 with appropriate movement play which can be best seen in FIGS. 2, 2'. The guide part 7 and the neck ring 9 are connected with the helmet shell e.g. by means of glue.

FIG. 2 shows the spatial arrangement of manual control part 4, neck ring 9, and helmet shell, while FIG. 3 shows the corresponding part in a perspective view.

In the illustrated embodiment, the lower part of the manual control part 4 is concave. This is in order to pass testing in accordance with the regulation that the closure must not open when a test ball with a diameter of 100 mm is pressed against it.

In a neutral position of the manual control device (operating position of the helmet), the manual control part 4 is urged downward, against the direction arrow 13, by means of spring force, provided e.g. in the adjustment mechanism. In this position, the outer contour of the helmet shell is thus complete, with the exception of the minor rises formed by the raised edges 15 of the guide part 7 and the concave area 12, whereby the demonstrated disadvantages in handling according to the state of the art are generally eliminated. Only at very high speeds will there still be potentially disturbing turbulence at the edges 14 and/or 15 of the guide part 7.

In order to completely eliminate this disturbance as well, a second embodiment according to FIGS. 5-8 is suggested, namely in accordance with the previously described further development of the inventive concept. In this embodiment, activation surface 21' of the manual control is kept completely flush with the helmet shell.

FIG. 5 shows a manual control device having a control part 16, guided in a specifically developed neck ring 17 with a combined guide part 18 so as to form one constructive or integral unit which is preferably manufactured from a synthetic material. In the helmet shell 19, a depression 21 (FIG. 8) with a depth corresponding to the thickness of the guide part 18 is provided to displace the edge of the combined neck ring 17 and guide part 18 inward in relation to the surface of the helmet shell. Thereby, after assembly of the combined neck ring 17/guide part 18 and the helmet shell 19 form a continuous surface. As shown in side cross-section section view in FIG. 6, the manual control part 16 is bent inward and guided in an oblique slot 22 (FIGS. 6 and 8) which permits some play.

Figure 6:
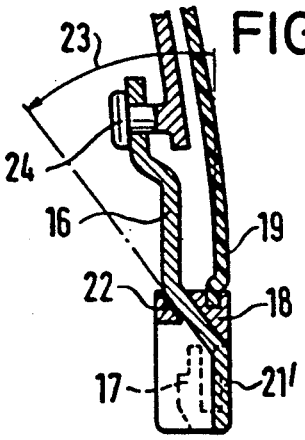
FIG. 6 is a partial sectional view from VI—VI in FIG. 5.
Figure 7:
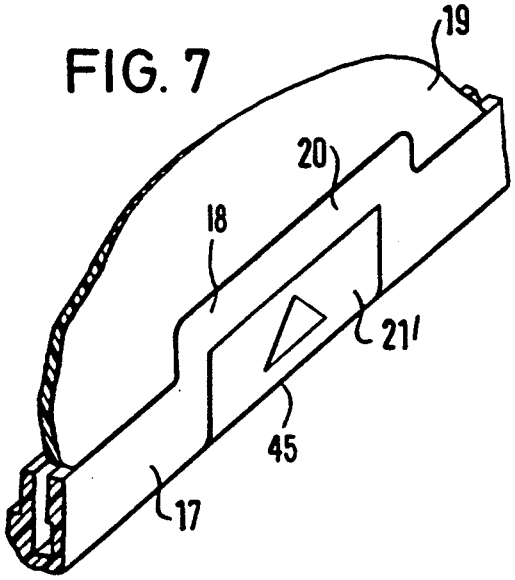
FIG. 7 is a perspective detail view of the guidance device of FIG. 5.
Figure 7:
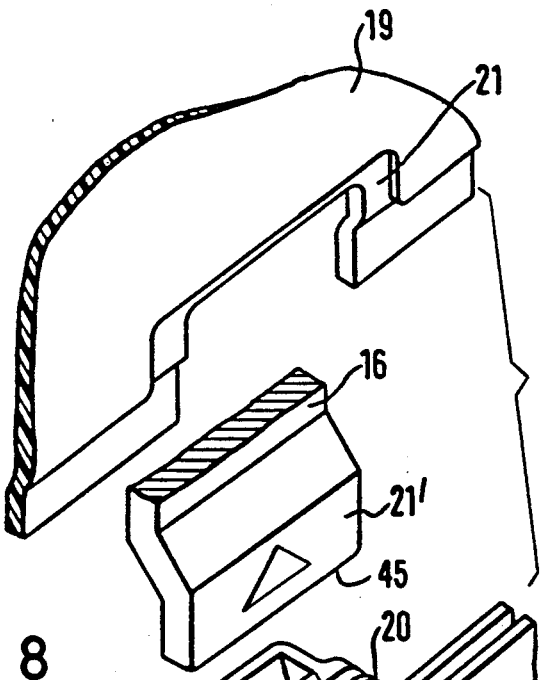
Figure 8:
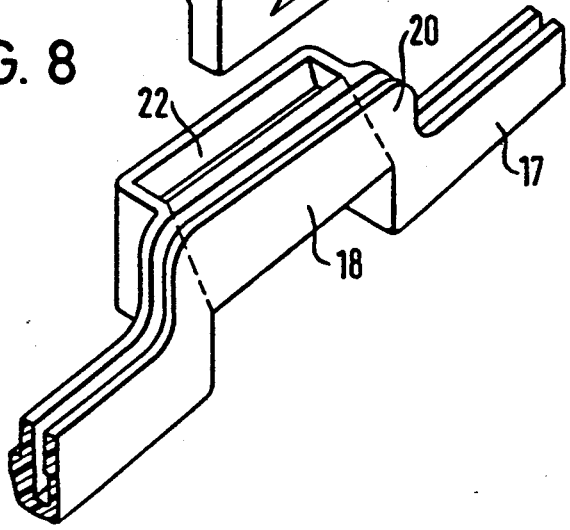
FIG. 8 are individual parts of the execution according to FIGS. 5-7, in an exploded view.

As shown in FIG. 6, the device can be characterized in that as seen upwards into the interior of the helmet from below, the guide opening or slot 22 is formed with an inward slant and the manual control part 16 has a corresponding bend, so that in the neutral position, the front side of the manual control part 16 rests in the outside contour of the helmet shell.

When the manual control part 16 is activated upwards, it moves inward corresponding to the angle 23. This movement must also be taken into consideration a the connection point 24 for the adjustment device.

Thereby, the manual control part 16 in its neutral position has a flush contour both with the neck ring at a pressure surface 45 (i.e., lower edge not concave), and activation surface 21', so that there are not more distributing edges.

In this case, the closure or adjustment device must have some play (safety distance).

An additional advantageous embodiment for a manual activation device of this nature is clearly illustrated in FIGS. 9 through 13. In this embodiment as well, the helmet shell and the neck ring have a completely uniform outside contour if the manual control part is in its neutral position (see FIG. 10). In this embodiment, a manual control part 46 is also held and guided in a specially designed guide part 18.

The details of the shape of the guide part 18 are represented in a perspective view in FIG. 13.

In this embodiment, the manual control part 46 is provided with guide projections 25, sliding in corresponding guide grooves 50 in the guide part 18.

Thereby, in an embodiment according to FIGS. 5 through 8 and as shown in FIG. 10, each guide groove may run on a straight line obliquely upwards at an angle $\alpha$ to the vertical, whereby the manual control part 46 is correspondingly guided obliquely upwards when activated, namely to activate the locking and adjustment mechanism. However, for certain applications it may be particularly advantageous that this angle $\alpha$ between the groove path 50' and the vertical is initially quite flat, as shown in the angle $\alpha'$ in FIG. 12, and that it then runs with a corresponding increase, as is also shown in FIG. 12, angle $\alpha''$. Thereby, the transition from one angle to another may be continuous, if an arced path of the groove is selected.

By this precaution, it is guaranteed that the locking cannot be disengaged e.g. in the case of a fall or other unusual occurrence, or under pressure from the side as indicated by the arrow Z in FIG. 10, but exclusively by pressure from below on the manual control part 46. No force from below can occur accidentally.

In the embodiment according to FIG. 9, the guide of the pressure key is represented with a certain lateral play. In practice, it seems necessary to allow a certain play in order to balance manufacturing tolerances and in order to guarantee easy activation of the pressure key.

In order to exclude potential flutter of the manual control part 46 and the noise related thereto, which is generated by wind pressure at higher speeds, a recess 26 in the manual control part 46 is provided in the selected embodiment, into which recess an anchoring projection 27 on the guide piece 18 will engage, which projection, as illustrated, is designed so that in the neutral position, there is only minimal play between the anchoring projection and the recess. At this location, manufacturing techniques can guarantee minimal play without particular cost, since the diameter of the anchoring projection 27 is very small and, for practical purposes, molding shrinkage and other manufacturing tolerances can thus be practically neglected.

In the interior of the guide piece 18, clamping tongues 28 are provided so that the guide piece can be clamped together with the helmet or with the helmet shell, independently of the attachment via the neck ring profile 9.

A common feature of the preceding embodiments of the operating device according to the invention was that in each case, the manual control part was pushed upward with respect to the guide part, whereby various guide devices were provided for the displacement necessary for the activation.

However, it is also possible to achieve the desired control movement by means of tilting or turning the correspondingly guided manual control part, whereby in this case as well, the desired continuous surface area of the lower edge of the helmet shell is retained in its neutral position.

Figure 14:
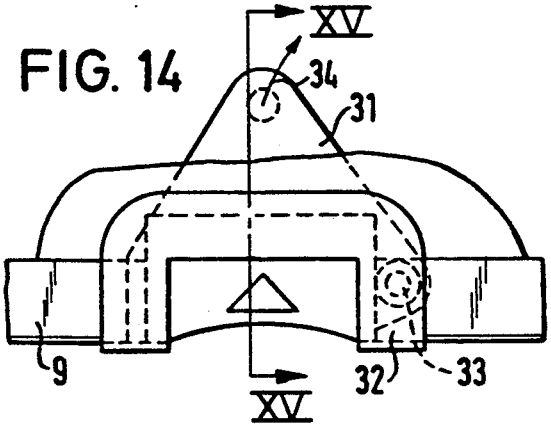
FIG. 14 is a top view of the manual control device with a manual control part which can be turned according to a fourth embodiment of the invention.
Figure 15:
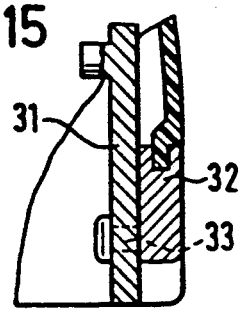
FIG. 15 is a sectional view through the manual control device from XV—XV in FIG. 14.
Figure 16:
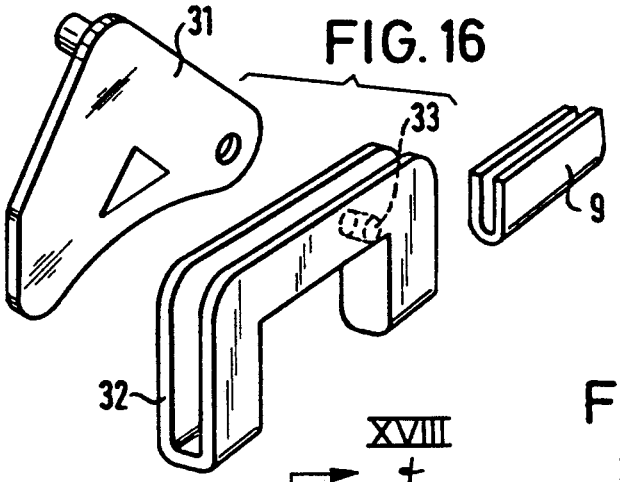
FIG. 16 is an exploded view of manual control device and guide piece of FIG. 14.
Figure 17:
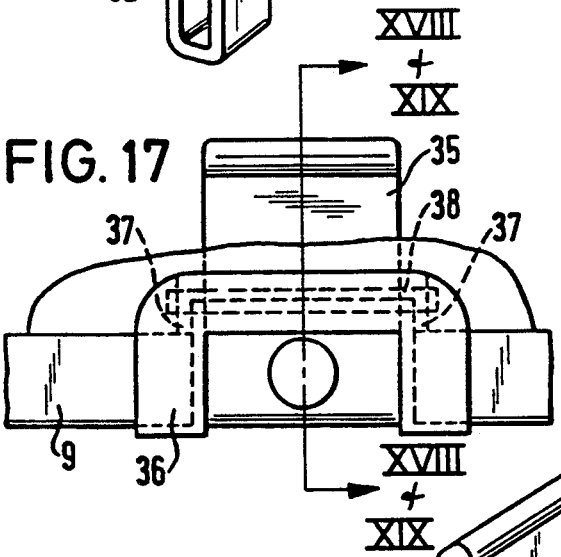
FIG. 17 is a top view of the manual control device of a fifth execution example.

A potential embodiment with a turning movement will be explained in the following with reference to FIGS. 14 through 16. In this case, the manual control part 31 is unilaterally journalled on a pivot 33 which defines a lever in the corresponding guide piece 32. When the manual control part is activated by pressure from below, the manual control part 31 is turned and moves upwards along a circular arc. This is indicated by means of the arrow 34 in FIG. 14. This movement can then be directly or indirectly utilized for the release of the closure or locking of the chin strap etc. It can be seen that in this embodiment, the guide piece 32 may be particularly simply designed, whereby, however, as is also the case in the embodiment according to FIGS. 2 through 4, such edges of the guide piece as extend partially beyond the edge of the helmet can be completely eliminated only by means of specific features, e.g. removable covers. The effect of the edges can also be reduced by means of an oblique arrangement of the guide projection.

Another embodiment with a manual control part that can be tilted into itself is shown in FIGS. 17 through 20. In this embodiment, the manual control part 35 is bent in a manner similar to that in the embodiment according to FIGS. 5–8. the front of its activation surface fits neatly into the recess of the correspondingly shaped guide piece 36.

In this case, however, the manual control part 35 is journalled so that it can be turned by means of a plug pivot 38 on the back side of the guide piece, where two holding projections 37 are provided.

Figure 18:
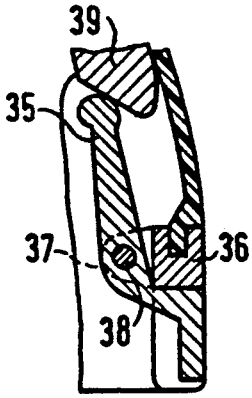
FIG. 18 is a sectional representation according to FIG. 17, wherein the manual control device is operable by pushing inwardly from the neutral position.
Figure 19:
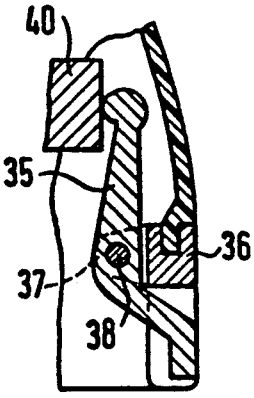
FIG. 19 is a section according to FIG. 17, wherein the manual control device is operable by pushing outwardly from the neutral position.
Figure 20:
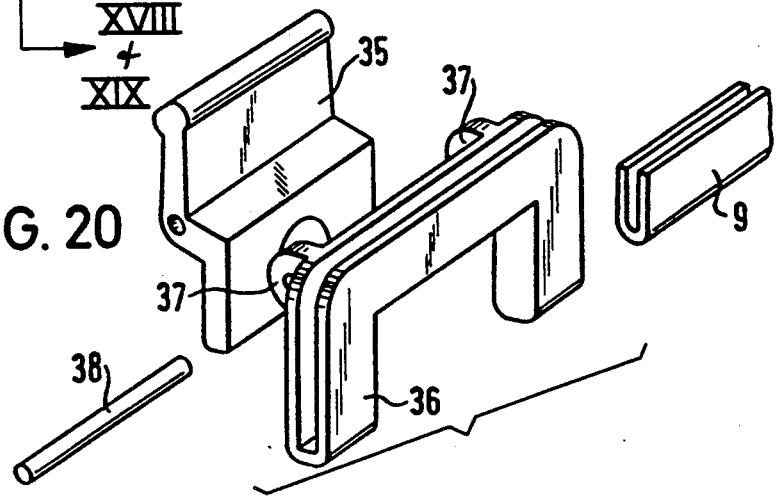
FIG. 20 is a exploded view of the individual parts for attaching the manual control device to the lower edge of the helmet for both potential turning movements shown in FIGS. 17-19.
Figure 21:
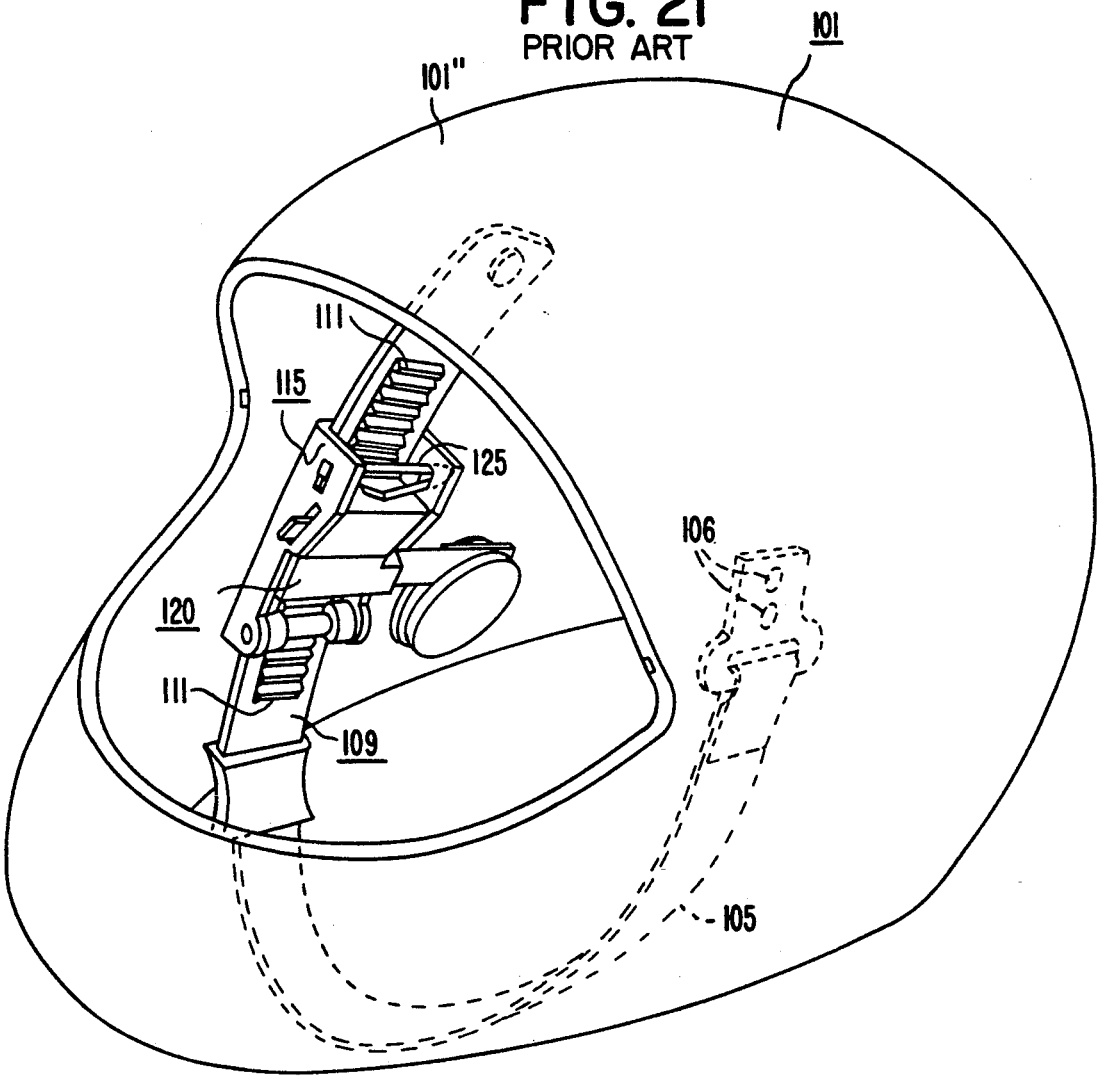
FIG. 21 PRIOR ART
FIG. 21 is a perspective view of the prior art helmet of the Offenlegungsschrift Pat. No. DE 33 30 697 disclosure.
Figure 22:
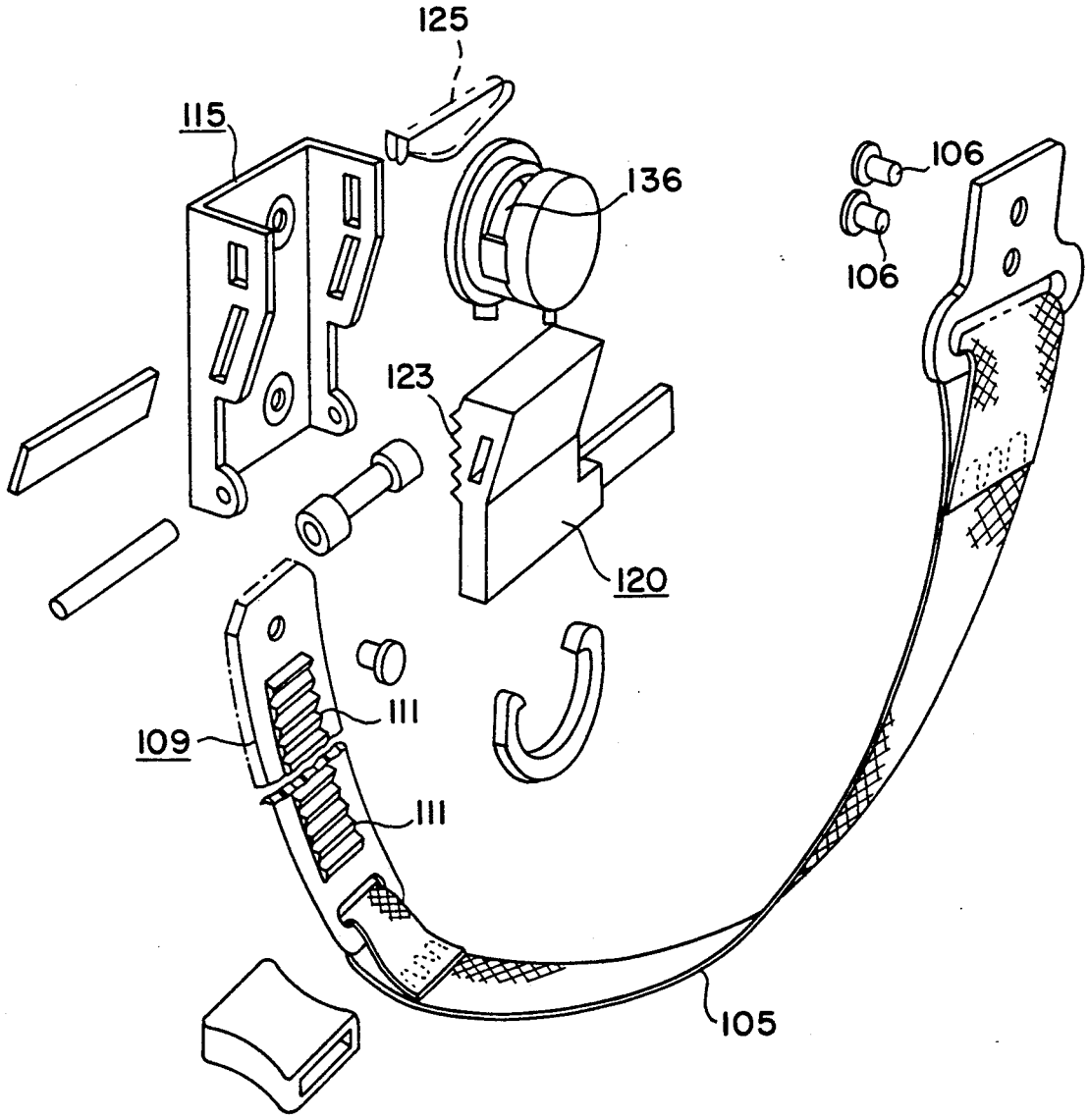
FIG. 22 PRIOR ART
FIG. 22 is an exploded view of the chin strap and operating device of the prior art Offenlegungsschrift Pat. No. DE 33 30 697 disclosure.

In this case, the operational position can be achieved thereby that, in accordance with the concepts of the invention, the manual control part 35 is pressed inward by means of the activation surface, in order to impose a control movement on a switching part 39, which is clearly illustrated in FIG. 18, or, the designer decides that in order to activate the correspondingly located switching part 40, the manual control part is to be pulled outwards from its neutral position, whereby the counter-lever of the manual control device swings inward, away from the helmet shell, as indicated in FIG. 19. The switching part 39 and switching part 40 each define a deflection lever which is movable via the manual control part 35 for indirect activation of the closure device.

Both alternatives can be implemented with equal advantage within the framework of the invention, whereby an inward activation, FIG. 18, offers the additional but minor advantage that the manual control part 35 and the guide piece 36 form a tight closure on the front side, while with the execution according to FIG. 19, a certain movement gap must remain, though in the area of the lower edge of the helmet, it causes no disturbance.

Figure 23:
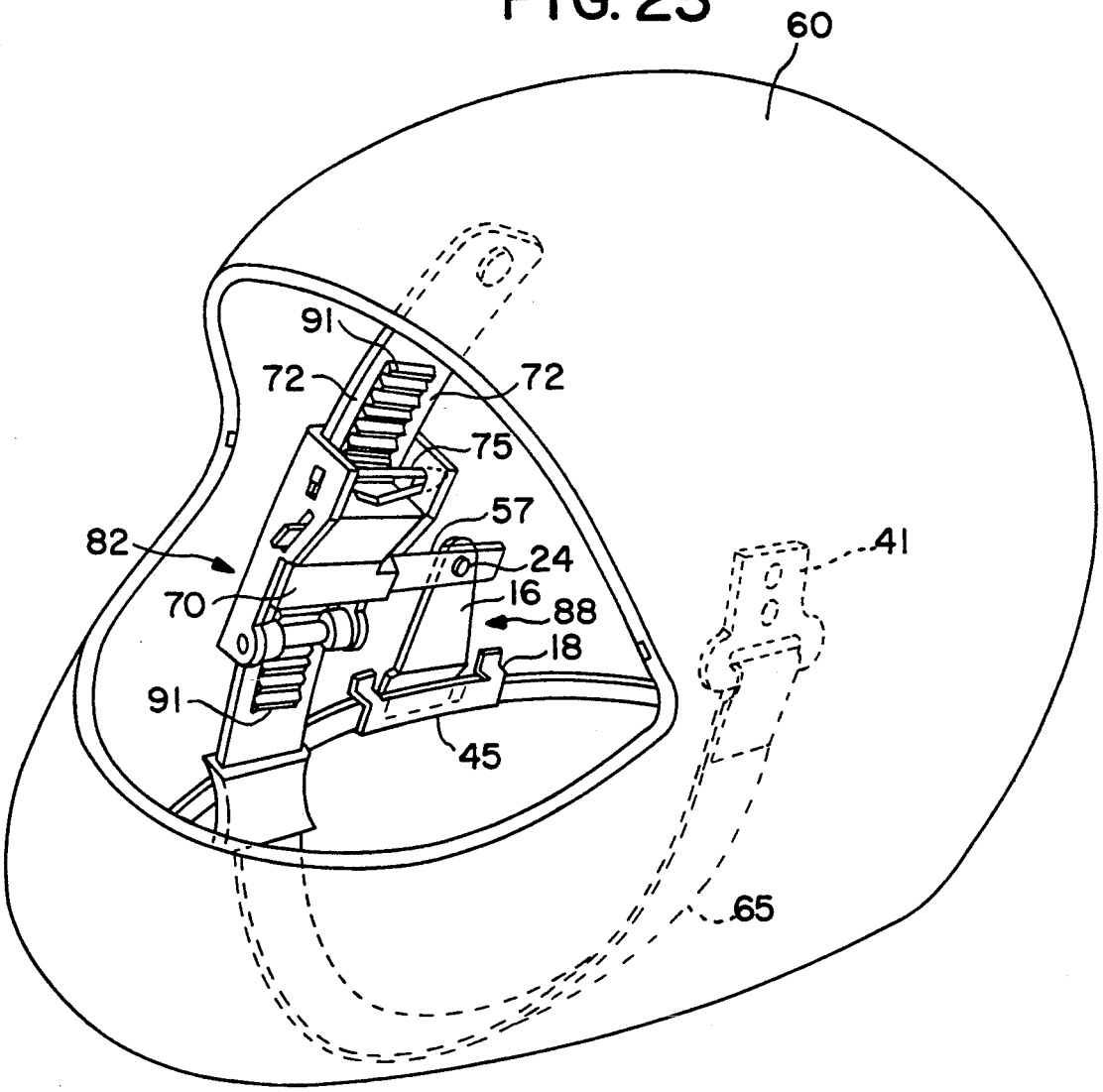
FIG. 23 is a perspective view of a helmet having the control device according to the invention, showing the control device linked to a locking and adjustment mechanism for the chin strap.

FIG. 23 illustrates the manual control device according to the invention which is connected for operating a locking and adjustment mechanism as is known in the prior art. A protective helmet 60 has a chin strap 65 which is fixed at one end 41 to the inside of the helmet shell. An opposite end 72 of the chin strap 65 is adjustably mounted in a chin strap adjustment and locking device 82 so as to render the chin strap length adjustable. The adjustably mounted end 72 of the chin strap has a plurality of inwardly facing notches 91 defining a span of adjustment. The notches 91 engage at a point selected by the user with a tab 70 having outwardly facing teeth that correspond to the notches 91. The tab 70 is resiliently urged against the strap notches 91 by a spring 75, to hold the strap 65 at a desired length. A control device 88 is connected for lifting the tab 70 inwardly of the helmet shell against the pressure of the spring 75. The control device 88 may be constructed according to the embodiment of, for example, FIGS. 5–8 wherein the guide part 18 has the angled slot 22 (shown in FIG. 6) for guiding the manual control part 16 upwardly inwardly when pressure is applied to the pressure surface 45. The control part 16 is connected to linkage 57 at connection point 24 for moving the tab 70. The connection point 24 permits pivoting in a vertical plane between the control part 16 and the linkage 57. A corresponding pivoting connection may be provided between the linkage 57 and the tab 70, if necessary, to avoid most upward movement of the tab 70 upon upward movement of the control part 16. Therefore, when upward pressure is applied to the pressure surface 45 of the control part 16, the tab 70 is urged inwardly in an arc for disengaging from the notches 91 of the chin strap 65. It should be apparent to a person of ordinary skill in the art how to connect the prior art locking and adjustment mechanisms to any of the other embodiments of the control device according to the invention.

It should also be apparent to a person of ordinary skill in the art to provide a stop point or dead point in order to permit release of the chin strap only upon application of a predetermined minimum pressure to the control part.

I claim:

1. A control device for actuating a locking device placed inside a shell of a helmet for changing a locking condition of a chin strap of the helmet, comprising:

a control part having a surface which is accessible from outside the helmet shell, wherein the control part is integrated with the helmet shell in an area of a neck ring of the helmet shell such that in a neutral position of the control device, the surface of the control part is continuous with an outer surface of the helmet shell, forming at most a minor interruption of the outer surface of the helmet shell; and, guide means in the neck ring area of the helmet shell for guiding the control part into the helmet shell upon application of a vertical force, wherein said guide means includes a guide part for guiding the control part, the guide part being provided in a cut-out at an edge of the helmet shell, the cut-out being dimensioned to accommodate the control device.

2. The device according to claim 1, wherein the guide part and the neck ring are inserted laterally into each other.

3. The device according to claim 1, wherein the guide part and the neck ring form one constructive unit manufactured from a synthetic material.

4. The device according to claim 1, wherein on an inside of the helmet shell, the guide part has a guide opening in which the control part is guided such that the control part can be vertically displaced.

5. The device according to claim 7, wherein an viewed from lower, interior portions of the helmet, the guide opening has an inward bend and the control part has a corresponding curve, such that when the control device is in the neutral position, an outer side of the control part rests along an outside contour of the helmet shell.

6. The device according to claim 1, wherein a lower edge of the control part runs flush with the edge of the neck ring attached to the guide means, said lower edge of the control part serving as a pressure surface.

7. The device according to claim 1, wherein the control device is linked for direct activation of the locking device for the chin strap.

8. The device according to claim 1, further comprising a deflection lever movable via the control part for indirect activation of a closure device for the chin strap.

9. The device according to claim 1, wherein within the guide part, the control part can be turned around a pivot defining a lever, and that in the neutral position of the control device, an activation surface of the lever is flush with an external contour of the helmet shell.

10. The device according to claim 1, wherein the control part is journalled at one side so that it can be turned.

11. The device according to claim 1, wherein the control part is guided by at least one guide groove in said guide means.

12. The device according to claim 14, wherein the guide means defines a pair of guide grooves configured to define an activation path of said control part, said activation path providing initially a substantially vertical displacement of the control part and thereafter an oblique guided displacement of the control part.

* * * * *

UNITED STATES PATENT AND TRADEMARK OFFICE

CERTIFICATE OF CORRECTION

PATENT NO. : 5,203,034

DATED : April 20, 1993

INVENTOR(S) : Artur Foehl

It is certified that error appears in the above-identified patent and that said Letters Patent is hereby corrected as shown below:

On the title page, item (30):

In the Foreign Application Priority Data, the following should be added: --08/19/87 -- PCT/DE87/00368--.

In the Abstract, insert --inside-- after "the", first occurrence, and before "of".

Column 1, line 50, "Rnd" should read --end--.

Column 3, line 23, replace "9-2" with --9-12--.

Column 3, line 39, replace "a" with --an--.

Column 4, line 44, delete "section".

Column 4, line 56, replace "a" with --at--.

Column 8, line 13, replace "7" with --4--, and "an" with --as--.

Column 8, line 41, replace "14" with --11--.

Signed and Sealed this

Eleventh Day of January, 1994

*Attest:*

Bruce Lehman

BRUCE LEHMAN

*Attesting Officer*

*Commissioner of Patents and Trademarks*